US006853813B2

(12) United States Patent
Miyazaki

(10) Patent No.: US 6,853,813 B2
(45) Date of Patent: Feb. 8, 2005

(54) IMAGE FORMING METHOD FEATURING A STEP OF THERMALLY-FIXING PERFORMED AFTER STEPS OF SEPARATELY-APPLYING TONER AND INK TO A RECORDING MEDIUM AND RELATED APPARATUS

(75) Inventor: Takeshi Miyazaki, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/603,613

(22) Filed: Jun. 26, 2003

(65) Prior Publication Data

US 2004/0005155 A1 Jan. 8, 2004

(30) Foreign Application Priority Data

Jul. 8, 2002 (JP) ..... 2002-198639

(51) Int. Cl.[7] ..... B41J 3/54; G03G 15/00; G03G 15/20; G03G 21/00

(52) U.S. Cl. ..... 399/2; 347/2; 399/298; 399/321

(58) Field of Search ..... 399/1, 2, 130, 399/139, 298, 299, 300, 320, 321; 347/1, 2

(56) References Cited

U.S. PATENT DOCUMENTS 5,081,596 A 1/1992 Vincent et al. ..... 358/1.4
5,444,518 A * 8/1995 Hashiguchi et al. ..... 399/1 X
5,570,451 A * 10/1996 Sakaizawa et al. ..... 399/2
5,729,785 A * 3/1998 Sakaizawa et al. ..... 399/2
5,761,565 A * 6/1998 Baker et al. ..... 399/2
6,588,888 B2 * 7/2003 Jeanmaire et al. ..... 347/77
2002/0171716 A1 * 11/2002 Jeanmaire ..... 347/74
2003/0063912 A1 * 4/2003 Miyazaki et al. ..... 399/2

FOREIGN PATENT DOCUMENTS

| | | | |
|---|---|---|---|
| JP | 04-069694 | * | 3/1992 |
| JP | 05-031966 | * | 2/1993 |
| JP | 7-205542 | | 8/1995 |
| JP | 7-223362 | | 8/1995 |
| JP | 07-276782 | * | 10/1995 |
| JP | 08-185077 | * | 7/1996 |
| JP | 11-277814 | | 10/1999 |
| JP | 2002-361939 | * | 12/2002 |

* cited by examiner

*Primary Examiner*—Sophia S. Chen
(74) *Attorney, Agent, or Firm*—Fitzpatrick, Cella, Harper & Scinto

(57) ABSTRACT

An image formation apparatus and method forms an image on a recording medium and includes a toner applying step for applying fusible powder toner to a recording medium to form a toner image, a semi-fixing step for semi-fixing the toner image, an ink applying step for applying liquid ink containing a coloring to the recording medium to form an ink image, and a thermal fixing step for thermally fixing an image formed by the toner applying step and the ink applying step.

14 Claims, 1 Drawing Sheet

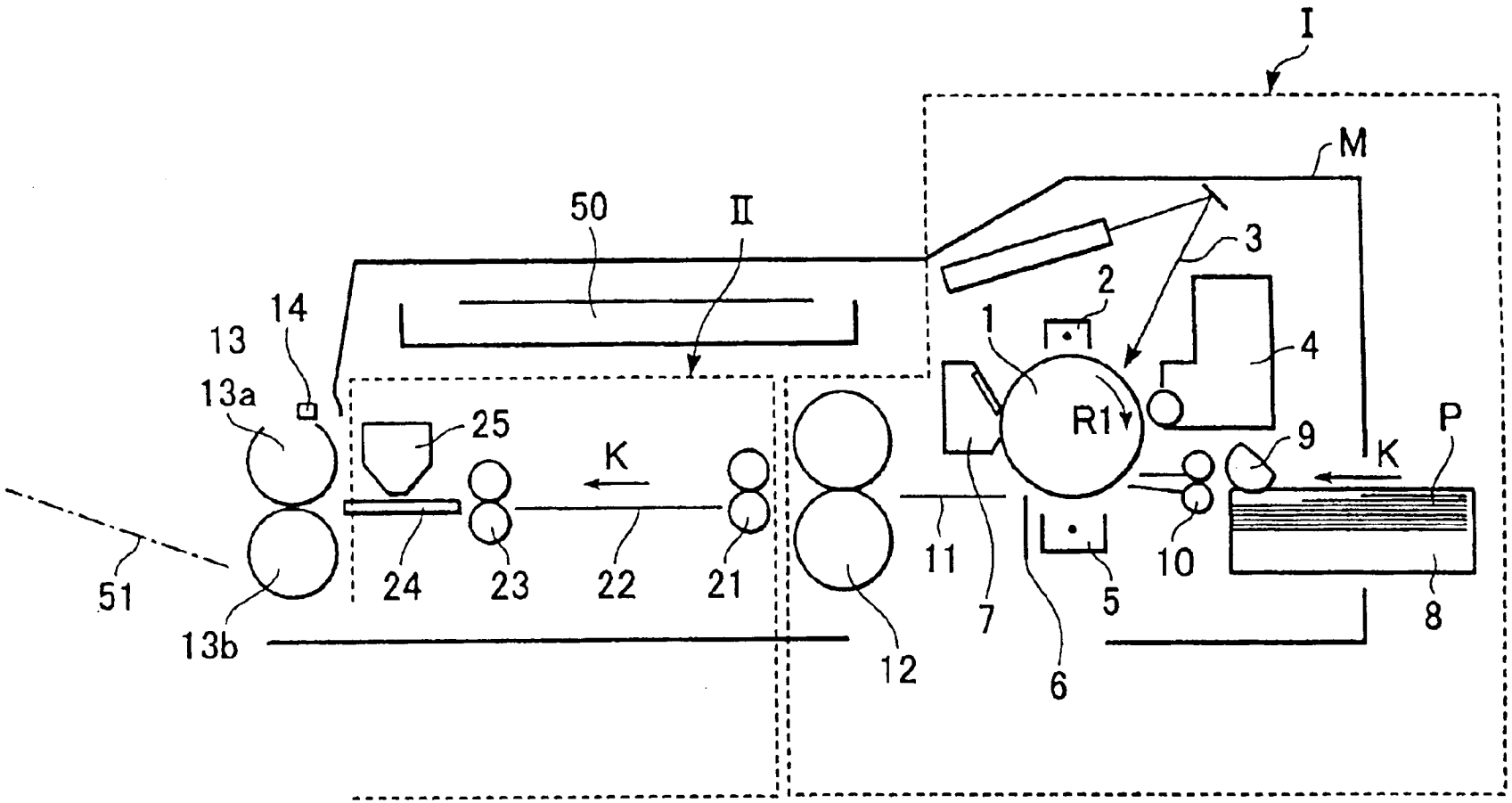
I
M
P
8
K
4
9
3
10
2
R1
5
6
1
7
11
12
II
21
50
K
22
23
25
24
14
13
13a
13b
51

IMAGE FORMING METHOD FEATURING A STEP OF THERMALLY-FIXING PERFORMED AFTER STEPS OF SEPARATELY-APPLYING TONER AND INK TO A RECORDING MEDIUM AND RELATED APPARATUS

BACKGROUND OF THE INVENTION

1. Field of the Invention

The present invention relates to an image formation method wherein an image is formed with powder toner and liquid ink, and to an apparatus for carrying out the method.

2. Description of the Related Art

Conventional representative examples of methods for forming color images with printers, photocopiers, facsimile apparatuses, and so forth, include electrophotography and ink jet image formation.

With electrophotography, for example, a toner image is formed on a photosensitive drum by charging, exposing, and developing means disposed around the photosensitive drum, the toner image is transferred onto a recording medium, and finally the toner image on the recording medium is fixed by fixing means. Monotone arrangements can be configured relatively small, but color electrophotography apparatuses results in a large apparatus and high costs.

On the other hand, with the later ink jet method, ink is directly discharged onto the recording medium from a recording head to form an ink image, so color apparatuses can be configured with relatively small arrangements, but there are various problems, such as insufficient rub-resistance and water resistance of the printed article immediately following printing, and also, in the event of using plain paper for the recording medium, bleeding can occur between the colors, deteriorating the image quality in comparison with electrophotography.

While image formation methods having both electrophotography image formation means and ink jet image formation means have been proposed to solve these problems, there is still room for improvement such as with the following points:

1) The ink is sometimes repelled by the toner at adjacent or overlapping portions between the toner image and the ink image.
2) The image may bleed due to mixture of color inks.
3) The recording medium may become bloated immediately following application of the color medium to a paper recording medium or the like, and depending on the degree of bloating, the recording medium may become undulated, leading to creasing or curling.
4) In the event of performing thermal fixing after forming the toner image, and then forming an image by ink jet image formation, the recording medium formed of paper or the like may shrink, leading to imperfectly aligned toner and ink images.

For example, U.S. Pat. No. 5,081,596 proposes a system wherein an electrophotography (laser printer) unit and an ink jet unit are combined, but no means for avoiding the above problems are mentioned. Also, Japanese Patent Laid-Open No. 7-205542, Japanese Patent Laid-Open No. 7-223362, and Japanese Patent Laid-Open No. 11-277814 disclose methods for forming an image with color water-based ink following formation of an image with black toner, but these still have not solved the above problems.

Specifically, in the event of recording an ink jet image with water-based ink following forming and fixing a toner image, as described in Japanese Patent Laid-Open No. 7-223362, the ink is repelled by the toner image. On the other hand, in the event of switching between formation of dots with toner and formation of dots with ink for the same color, based on the attributes of an object image as described in Japanese Patent Laid-Open No. 11-277814, the apparatus becomes complex.

SUMMARY OF THE INVENTION

The present invention has been made in light of the aforementioned problems, and accordingly, it is an object hereof to provide an image formation method and an apparatus thereof wherein high-quality images can be formed, without creasing, curling, or imperfect alignment of the image, while avoiding increased size and costs of the apparatus.

In order to achieve the above objects, the Inventors studied various types of inks and processes, and found that forming an ink image in a state wherein the toner image is not completely fixed, or preferably using semi-fixing means following formation of the toner image, prevents imperfect alignment between the toner image and the ink image and also the ink is not so readily repelled by the toner at adjacent or overlapping portions between the toner image and the ink image, thus leading to the present invention. That is to say, with toner image portions in a semi-fixed state, the toner particles are not completely fused one to another so there are minute gaps therebetween and accordingly, the ink can be expected to be absorbed thereby due to capillary action.

Accordingly, the image formation method and apparatus according to the present invention are as follows.

The image formation method according to an embodiment of the present invention for forming an image on a recording medium comprises the following steps: a first step for applying fusible powder toner to a recording medium to form a toner image; a second step for applying liquid ink containing a coloring material to the recording medium to form an ink image; and a third step for performing thermal fixing of an image formed by the first and second steps.

The image formation method may further comprise a step for semi-fixing a toner image between the first and second steps. The fixing step may be pressurizing fixing.

The fusible powder toner may contain a black coloring agent, and the liquid ink may comprise at least inks of the three colors of yellow, magenta, and cyan, or the liquid ink may comprise at least inks of the four colors of yellow, magenta, cyan, and black. Also, the liquid ink may comprise at least a coloring material and a non-aqueous solvent.

Further, in the second step, liquid ink may be applied to the recording medium by ink-jet recording.

The image formation apparatus according to the present invention for forming an image on a recording medium comprises: first means for applying fusible powder toner to a recording medium to form a toner image; means for semi-fixing the toner image; second means for applying liquid ink containing a coloring material to the recording medium to form an ink image; and third means for performing thermal fixing of an image formed by the first and second means.

Further objects, features and advantages of the present invention will become apparent from the following description of the preferred embodiments (with reference to the attached drawings).

BRIEF DESCRIPTION OF THE DRAWINGS

The FIGURE is an overall configuration diagram illustrating an example of the image formation apparatus according to the present invention.

DESCRIPTION OF THE PREFERRED EMBODIMENTS

The present invention will be described in further detail with the following embodiment.

An image can be formed on a recording medium by performing the following steps in order: a first step for applying fusible powder toner to a recording medium to form a toner image; a second step for applying liquid ink containing a coloring material to the recording medium to form an ink image; and a third step for performing thermal fixing of an image formed by the first and second steps.

The image formation method may further comprises a step for semi-fixing a toner image between the first and second steps. The term "semi-fixing" here refers to fixing to a degree at least where the toner image formed on the recording medium is not affected by vibrations or movement or air while being transported. More preferably, the semi-fixing is performed to a degree where the toner image does not run or bleed upon ink droplets being provided by the ink jet image formation means downstream. On the other hand, fixing wherein the toner powder completely fuses due to thermal fusing and is fixed to the recording medium, is undesirable. That is, in the event that complete fixing is performed, this impedes absorption of the ink upon the ink droplets being applied by the ink jet image formation means downstream, and also leads to ink on the surface of one sheet smearing onto the back side of another sheet upon the recording medium being discharged, since drying of the ink is impeded due to insufficient absorption by the recording medium. Also, in the event of not fixing at all, the toner image may run or bleed upon ink droplets being provided by the ink jet image formation means downstream as mentioned above.

There are several methods available for realizing semi-fixing of the toner image, such as a method for electrostatic absorption and holding of the toner image by the recording medium P, a method for pneumatic suction from the rear side of the recording medium to hold the toner image, a method using pressurizing fixing, and so forth. Of these, electrostatic absorption has a problem in that the holding force of the toner is weak. Pneumatic suction from the rear side of the recording medium has a problem in that the transmissivity of air may differ according to the type of recording medium, so control may be difficult. On the other hand, pressurizing fixing uses a simple mechanism of a pressurizing roller or the like, and control thereof is easy, so pressurizing fixing means are preferably used for the semi-fixing step with the present invention.

The ideal semi-fixing state for the toner image is a state wherein the toner particles are held by the recording medium with gaps between the particles, so the ink can be absorbed into the gaps between these particles by capillary action.

As for the powder toner used for the present invention, a known powder toner which is capable of image formation by electrophotography can be used, preferably using a powder toner capable of forming an image with black coloring material, such as a powder toner containing black coloring material within a binder. The reason for this is that high-quality images with little bleeding is often required for black characters.

As for the ink used with the present invention, a liquid ink containing at least a coloring material in a liquid medium is used. The liquid ink may be either an aqueous or non-aqueous ink, but a non-aqueous ink is preferable from the perspective of preventing wrinkling and curling.

As for the coloring material, various types of dyes and pigments, non-organic particles, metal particles, colored polymers or colored waxes, etc., may be used, but oil-soluble dyes or pigments are suitably used in the event of using a non-aqueous ink.

Examples of oil-soluble dyes include azoic dyes and phthalocyanine dyes, and examples of oil-soluble pigments include inorganic pigments such as Carbon Black or organic pigments such as azoic pigments, phthalocyanine pigments, isoindoline pigments, quinacridone pigments, perynon or perylene pigments, and so forth. Further, altered pigments wherein the surface of particles are covered with resin or the like, can also be used. With the above-described dyes and pigments, two or more types can be mixed and used. A preferable amount of coloring material is 1 to 10% by mass.

Further, a resin may be included in the ink as a binder. A polymer compound capable of dissolving in the ink is sufficient for the resin, with specific examples including ethyl cellulose, polyacrylic ester, linseed oil, denatured alkyd resin, polystyrene, polyvinyl chloride, chlorinated polypropylene, polyamide resin, coumarone-indene resin, rosin resin, terpene phenol resin, alkyl phenol denatured xylene, and so forth. A combination of two or more these resins may be used in some cases. Also, the preferable amount of resin in the ink is 1 to 10% by mass.

Non-aqueous solvents used for the liquid medium in non-aqueous inks include ketones, alcohols, carboxylate ester, and so forth, but particularly preferably are those with low toxicity, low flammability, and little smell, examples including aliphatic hydrocarbons, isoparaffin hydrocarbons, n-paraffin hydrocarbons, alicyclic hydrocarbons, vegetable oils, various types of denatured silicone oils, etc., and two or more of these non-aqueous solvents may be mixed. The amount of the non-aqueous solvent in the ink is preferably 50 to 96% by mass.

Also, as for dispersants added as necessary, any compatibly soluble in the solvent or stably dispersible as fine particles therein may be used, specific examples thereof including nonionic activators such as sorbitan fatty acid ester (sorbitan monooleate, sorbitan monolaurate, sorbitan sesquioleate, sorbitan trioleate, etc.), polyoxyethylene sorbitan fatty acid ester (polyoxyethylene sorbitan monostearate, polyoxyethylene sorbitan monooleate, etc.), polyethylene glycol fatty acid ester (polyoxyethylene monostearate, polyoxyethylene glycol diisostearate, etc.), polyoxyethylene alkyl phenyl ether (polyoxyethylene nonyl phenyl ether), and so forth. Two or more of these dispersants may be mixed and used in some cases.

Further, resin may be added to serve as a binder component. Examples include phenol resin, acrylic resin and denatured resin thereof, mallein resin and denatured resin thereof, rosin resin, epoxy resin, silicone resin, fluorine resin, butyral resin, and so forth. Further, antioxidants and ultraviolet absorbents and so forth may also be used as suitable.

The embodiment of the present invention will be further described with reference to the drawing. FIG. 1 illustrates the overall configuration of an image formation apparatus according to the present invention.

With the present invention, the first step is a step for forming a toner image on the recording medium by applying powder toner thereto with a method such as electrophotography, and preferably, the toner image is semi-fixed onto the recording medium. Subsequently, an ink image is formed thereupon by applying liquid into to the recording medium by the ink jet method, thereby forming full-color images and so forth. That is to say, a main feature of the preferred embodiment of the present invention is that the toner image is fixed in two stages.

The image formation apparatus shown in the FIGURE has multiple image formation means which each use different image formation methods, and forms an image on the recording medium P by a series of image formation steps by the image formation means. Note that the image formation apparatus according to the present invention is capable of both ink jet recording and electrophotography recording, i.e., capable of synthesized or multiplex recording as to the same recording medium. Here, recording wherein the ink image region of the ink jet recording and the toner image region of the electrophotography recording do not overlap will be referred to as "synthesized recording", and recording wherein the ink image region of the ink jet recording and the toner image region of the electrophotography recording overlap will be referred to as "multiplex recording".

First, to describe the general configuration of the overall image formation apparatus, this apparatus main unit M comprises an electrophotography image formation means I serving as first image formation means disposed upstream in the image formation apparatus (the portion indicated by the dotted line to the right side in the FIGURE), and an ink jet image formation means II serving as second image formation means disposed downstream in the image formation apparatus (the portion indicated by the dotted line to the left side in the FIGURE). The terms "upstream" and "downstream" in the apparatus main unit M refer to the direction of transportation of the recording medium P in the series of image formation steps (the direction of the arrow K); in the FIGURE, the right side is the upstream side and the left side is the downstream side.

As for the general action of the overall image formation apparatus having the above-described configuration, a monotone toner image is formed with fusible powder toner (hereafter referred to simply as "toner") which is a developing agent, at the upstream image formation means (electrophotography) I, and a color ink images is formed of multiple color inks by the downstream image formation means (ink jet) II.

Next, the configuration of the image formation means I and the image formation means II will be described, in that order.

The image formation means I comprises a photosensitive drum 1 which is rotationally driven in the direction of the arrow R1, to serve as an image carrying member. Provided around the photosensitive drum 1, in approximate order along the rotating direction (direction of the arrow R1), are charging means 2, exposing means 3, developing means 4, transfer means 5, discharging means 6, and cleaning means 7. Specific examples of these means are a primary charger 2 for uniformly charging the surface of the photosensitive drum 1 to a predetermined negative potential, a laser exposing device 3 for exposing an image on the surface of the charged photosensitive drum 1 so as to form an electrostatic latent image, a developing device 4 for applying toner to the electrostatic latent image so as to perform inversion developing, a transfer charger 5 for transferring the toner image on the photosensitive drum 1 onto the recording medium P, a discharging needle 6 for removing the charge on the recording medium P following transfer, and a cleaner 7 for removing the residual toner on the photosensitive drum 1 following transfer of the toner image, and so forth. Here, the developing device 4 applies toner onto the electrostatic latent image on the photosensitive drum 1 by a process known as "jumping phenomenon", for example.

An example of the toner used here is an insulated magnetic toner, wherein a binding resin, whose primary component is a styrene-acrylic copolymer, contains 60% by weight of magnetite and 1% by weight of a metal complex of monoazoic dye serving as a negative charge controlling agent, prepared such that the overall volume resistivity is approximately $10^{13}$ Ω·cm.

A supply-and-transport unit for supplying and transporting the recording medium P is configured below the photosensitive drum 1. The supply-and-transport unit comprises, in order from the upstream side, a sheet supply cassette 8 which is detachably mounted to the apparatus main unit M for storing the recording medium P, a feeding roller 9 for feeding the recording medium P out from the sheet supply cassette 8, a resist roller 10 for supplying the recording medium P fed out from the sheet supply cassette 8 to the photosensitive drum 1 at a predetermined timing, and a transport guide 11 for guiding the recording medium P following transfer to the toner image thereupon. At the position farthest downstream in the supply-and-transport unit is disposed a pressurizing fixer 12 serving a pressurizing fixing means for semi-fixing of the toner image transferred from the photosensitive drum 1 by the transfer charger 5 onto the recording medium P.

With the present embodiment, semi-fixing is achieved by the pressurizing roller pressing the toner image against the recording medium P. In the event that the recording medium P is paper or the like, the toner particles are held by being pressed into gaps between pulp fibers by the pressurizing. Heat may also be applied at this time, but heating and pressurizing under temperature conditions wherein the toner is completely fused is undesirable.

Following subsequent image formation by ink jet recording at the image formation means II, the toner image is fixed again by second fixing means, and thus is completely fixed.

The image formation means II comprises, in order from the upstream side, a transport roller 21, transport guide 22, feeding roller 23, platen 24, and ink jet recording unit 25. The transport roller 21 consecutively feeds sheets of the recording medium P discharged from the pressurizing fixer 12 along the transport guide toward the feeding roller 23 (i.e., in the direction of the arrow K), and the feeding roller 23 consecutively feeds the sheets of the recording medium P to between the platen 24 and the ink jet recording unit 25 by a stepping motor (not shown). The ink jet recording unit 25 comprises line heads of each of the three colors of cyan (C), magenta (M), and yellow (Y). Or, the configuration may further include a black (Bk) head for a four line head arrangement. This configuration is effective for recording on OHP sheets and the like with the ink jet method alone.

Further, in the event that higher and smoother gradation with less graininess of the color image is desired, special color inks such as light magenta or light cyan may be used besides the above-described three colors of cyan magenta, and yellow. In this case, four or more color inks are used.

Also, tubes (not shown) corresponding to each color are connected to each recording head, so that ink of each color is supplied from ink tanks (not shown) holding the ink of each color to the corresponding heads via the tubes.

A controller 50 is disposed above the second image formation means II. This controller 50 is configured such that, in the event that print signals, and image data wherein a monochrome image and a color image both exist, are input to the image formation apparatus from an external device for example, the print signals and the monochrome image data is sent to the first image formation means I, and the print signals and the color image data is sent to the second image formation means II.

Further downstream from the image formation means II are disposed complete fixing means 13 (a thermal fixer) for completely fixing the semi-fixed toner image. The complete fixing means 13 (thermal fixer) comprises a heating roller 13*a* and a pressurizing roller 13*b*, and a temperature sensor 14. Further downstream from this is disposed a discharge tray 51 where sheet of the recording medium P following fixing are discharged.

Next, these actions will be described with reference to FIG. 1. Upon print signals, and image data wherein a monochrome image and a color image both exist, being input to the image formation apparatus from an external device, the controller 50 sends the print signals and the monotone image data to the first image formation means I. The recording medium P loaded in the sheet supply cassette 8 is fed out by the feeding roller 9, and supplied to the photosensitive drum 1 by the resist roller 10. Approximately parallel to the above actions, the photosensitive drum 1 is rotationally driven in the direction of the arrow R1, and the surface thereof is uniformly charged to a predetermined negative potential by the primary charger 2. The surface of the photosensitive drum 1 is irradiated by laser beams based on the image data by the laser exposing means 3, so that the charged on the irradiated portion is removed and an electrostatic latent image is formed on the surface. Black toner is a negative charge, stored in the developing device 4, adheres to the electrostatic latent image, and the electrostatic latent image is developed as a toner image. The toner image on the photosensitive drum 1 is transferred by the transfer charger 5 onto the recording medium P supplied to the photosensitive drum 1 by the resist roller 10. The recording medium P following transfer of the toner image is transported to the pressurizing fixer 12 along the transport guide 11, where the toner image is semi-fixed under pressurization. On the other hand, residual toner on the surface of the photosensitive drum 1 following transfer of the toner image is removed by the cleaner 7, so as to prepare for formation of the next image.

Upon the monotone toner image being formed on the recording medium P by the image formation steps of the first image formation means I, the recording medium P is transported from the first image formation means I to the second image formation means II. At the point that the recording medium P reaches the image formation means II, the transport roller 21 of the image formation means II consecutively transports the recording medium P along the transport guide 22 until the leading edge of the recording medium P reaches the feeding roller 23. Upon the leading edge of the recording medium P reaching the feeding roller 23, the feeding roller 23 and the transport roller 21 intermittently transport the recording medium P to the ink jet recording unit 25. At this time, print signals and color image data is sent form the controller 50 to the second image formation means II, and correspondingly, ink of each color is discharged from the ink jet recording head 25 to the recording medium P, thereby forming a color image. The recording medium P upon which the image has been formed is subjected to thermal fixing by the complete fixing means 13, and is discharged to the discharge tray 51.

Now, the following is a specific description of the present invention by way of examples. It should be noted however, that the present invention is by no means restricted to the following examples. Unless described otherwise, commercially-available high-quality products were used for the reagents and so forth.

First Example

Liquid inks of non-aqueous solvents were prepared for three colors, having the compositions described below. The percentages are % by mass.

| | |
|---|---|
| (Composition of the yellow (Y) ink) | |
| C.I. Pigment Yellow 93 | 5.0% |
| Isopar G (ExxonMobil Chemical) | 92.6% |
| Sorbitan monolaurate | 0.2% |
| Rosin denatured maleic acid resin (Arakawa Chemical Industries, Ltd.) | 2.2% |
| (Composition of the magenta (M) ink) | |
| C.I. Pigment Red 122 | 4.0% |
| Isopar G (ExxonMobil Chemical) | 93.6% |
| Sorbitan monolaurate | 0.2% |
| Rosin denatured maleic acid resin (Arakawa Chemical Industries, Ltd.) | 2.2% |
| (Composition of the cyan (C) ink) | |
| C.I. Pigment Blue 15:3 | 5.0% |
| Isopar G (ExxonMobil Chemical) | 92.6% |
| Sorbitan monolaurate | 0.2% |
| Rosin denatured maleic acid resin (Arakawa Chemical Industries, Ltd.) | 2.2% |

A multiplex color image was formed on paper (product name PB PAPER, manufactured by CANON KABUSHIKI KAISHA) by an apparatus with the above-described configuration and the above-described process, using fusible powder toner (an insulating magnetic toner, manufactured by CANON KABUSHIKI KAISHA) and the three color liquid inks.

Second Example

A second example was tested using exactly the same process and apparatus as with the first example, but the liquid inks were replaced with the following water-soluble inks for the three colors. The percentages are % by mass.

| | |
|---|---|
| (Composition of the yellow (Y) ink, standard for mass) | |
| C.I. Direct Yellow 86 | 3% |
| Diethylene glycol | 10% |
| Isopropyl alcohol | 2% |
| Urea | 5% |
| Acetynol EH (Kawaken Fine Chemicals Co., Ltd.) | 1% |
| Water | remaining percentage |
| (Composition of the magenta (M) ink, standard for mass) | |
| C.I. Acid Red 289 | 3% |
| Diethylene glycol | 10% |
| Isopropyl alcohol | 2% |
| Urea | 5% |
| Acetynol EH (Kawaken Fine Chemicals Co., Ltd.) | 1% |
| Water | remaining percentage |
| (Composition of the cyan (C) ink, standard for mass) | |
| C.I. Direct blue 199 | 3% |
| Diethylene glycol | 10% |
| Isopropyl alcohol | 2% |
| Urea | 5% |
| Acetynol EH (Kawaken Fine Chemicals Co., Ltd.) | 1% |
| Water | remaining percentage |

Results of Evaluation

The image samples obtained from the first and second examples exhibited high quality with no repelling of ink even where the liquid ink was applied over the toner image. Also, there was no trouble such as soiling of the fixing roller or set-off even at high speeds (60 sheets per minute).

Further, the first example wherein a liquid ink using a non-aqueous solvent exhibited practically no wrinkling or curling of the recording medium.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image formation method for forming an image on a recording medium, said method comprising:

a toner applying step for applying fusible powder toner to a recording medium to form a toner image;

a semi-fixing step of semi-fixing the toner image;

an ink applying step for applying liquid ink containing a coloring material to the recording medium to form an ink image; and a thermal fixing step for thermally fixing an image formed by said toner applying step and said ink applying step.

2. An image formation method according to claim 1, wherein said semi-fixing step is a pressurizing fixing step.

3. An image formation method according to claim 1, wherein the fusible powder toner contains a black coloring agent.

4. An image formation method according to claim 1, wherein the liquid ink comprises inks of the three colors of yellow, magenta, and cyan.

5. An image formation method according to claim 1, wherein the liquid ink comprises inks of the four colors of yellow, magenta, cyan, and black.

6. An image formation method according to claim 1, wherein the liquid ink comprises a coloring material and a non-aqueous solvent.

7. An image formation method according to claim 1, wherein, in said ink applying step, the liquid ink is applied to the recording medium by ink-jet recording.

8. An image formation apparatus for forming an image on a recording medium, said apparatus comprising:

toner applying means for applying fusible powder toner to a recording medium to form a toner image;

fixing means for semi-fixing the toner image formed by said toner applying means;

ink applying means for applying liquid ink containing a coloring material to said recording medium to form an ink image; and thermal fixing means for thermally fixing an image formed by said toner applying means and said ink applying means.

9. An image formation apparatus according to claim 8, wherein said fixing means comprises a pressurizing fixing means.

10. An image formation apparatus according to claim 8, wherein the fusible powder toner contains a black coloring agent.

11. An image formation apparatus according to claim 8, wherein the liquid ink comprises inks of the three colors of yellow, magenta, and cyan.

12. An image formation apparatus according to claim 8, wherein the liquid ink comprises inks of the four colors of yellow, magenta, cyan, and black.

13. An image formation apparatus according to claim 8, wherein the liquid ink comprises a coloring material and a non-aqueous solvent.

14. An image formation apparatus according to claim 8, wherein, said ink applying means applies the liquid ink to the recording medium by ink-jet recording.

* * * * *

UNITED STATES PATENT AND TRADEMARK OFFICE

CERTIFICATE OF CORRECTION

PATENT NO. : 6,853,813 B2
DATED : February 8, 2005
INVENTOR(S) : Takeshi Miyazaki It is certified that error appears in the above-identified patent and that said Letters Patent is hereby corrected as shown below:

Column 1,
Line 26, “results” should read -- result --.

Column 2,
Line 25, “one to” should read -- to one --; and
Line 65, “FIGURE” should read -- figure --.

Column 3,
Line 12, “may further comprises” should read -- may further comprise --.

Column 4,
Line 54, “FIG. 1” should read -- The figure --.

Column 5,
Line 1, “FIGURE” should read -- figure --;
Line 21, “FIGURE);” should read -- figure), --;
Line 25, “FIGURE).” should read -- figure). --;
Line 29, “FIGURE,” should read -- figure, --; and
Line 36, “images” should read -- image --.

Column 6,
Lines 30, 65 and 66, “is” should read -- are --.

Column 7,
Line 7, “sheet” should read -- sheets --;
Line 10, “FIG. 1.” should read -- the figure. --; and
Line 53, “form” should read -- from --.

Signed and Sealed this

Twenty-eighth Day of June, 2005

JON W. DUDAS
*Director of the United States Patent and Trademark Office*